US005750640A

United States Patent [19]

Scott et al.

[11] Patent Number: 5,750,640

[45] Date of Patent: May 12, 1998

[54] OIL-SOLUBLE REACTION PRODUCTS OF POLYENES

[75] Inventors: Richard Mark Scott; Robert William Shaw, both of Sittingbourne, England

[73] Assignee: Shell Oil Company, Houston, Tex.

[21] Appl. No.: 522,648

[22] Filed: Sep. 1, 1995

[30] Foreign Application Priority Data

Aug. 24, 1994 [EP] European Pat. Off. ..... 94306237

[51] Int. Cl.[6] ..... C08G 69/26; C08F 265/00; C10M 105/08

[52] U.S. Cl. ..... 528/332; 528/220; 528/229; 528/310; 525/301; 525/309; 252/51.5 A

[58] Field of Search ..... 252/51.5; 525/301, 525/309; 528/220, 229, 310, 332

[56] References Cited

U.S. PATENT DOCUMENTS 4,670,173 6/1987 Hayashi et al. .

FOREIGN PATENT DOCUMENTS 331397 2/1989 European Pat. Off. .
556915 2/1993 European Pat. Off. .
613887 2/1994 European Pat. Off. .

*Primary Examiner*—P. Hampton-Hightower

[57] ABSTRACT

The invention provides reaction products of:

(A) an acylating reagent, with (D) a polyalkenyl derivative of an ethylenically unsaturated carboxylic reagent (C), and (E) a polyamine containing at least two —$NH_2$ and/or —NH groups, or with (F) the pre-formed product of reagents (D) and (E), wherein the acylating reagent (A) is the reaction product of (B) a $C_4$–$C_{20}$ polyene or oligomer prepared therefrom, and (C) an ethylenically unsaturated carboxylic reagent; lubricating oil compositions, fuel compositions and additive concentrates containing them; and use of the reaction products as dispersant additives.

8 Claims, No Drawings

OIL-SOLUBLE REACTION PRODUCTS OF POLYENES

FIELD OF THE INVENTION

The present invention relates to reaction products of polyenes, a process for their preparation, lubricating oil compositions, fuel compositions and additive concentrates containing them and their use as dispersant additives.

BACKGROUND OF THE INVENTION

European Patent Application No. 94200496.1 (Applicant's ref: T-1659 EPC R) describes the use, as dispersant additives in lubricating oils (luboils), of mono- and bis-cyclopentadiene derivatives of the general formula

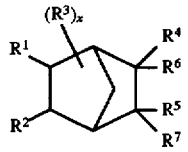

(I)

in which $R^1$ and $R^2$ each represent a hydrogen atom, or together represent a carbon-carbon single bond; each of $R^4$ and $R^5$ independently represents a hydrogen atom, or a $C_1$–$C_{20}$ alkyl or phenyl group, each of which may be optionally substituted; $R^6$ represents a hydrogen atom, or a $C_1$–$C_{20}$ alkyl or phenyl group, each of which may be optionally substituted and $R^7$ represents a group —$CH_2$—$NHR^8$ in which $R^8$ represents an optionally substituted alkyl group, or a group —COX wherein X represents an optionally substituted alkoxy group or —$NHR^8$ where $R^8$ is as defined above; or $R^6$ and $R^7$ together represent a group

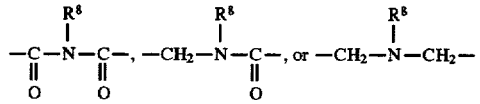

where $R^8$ is as defined above; x is 1 to 6, preferably 1 to 4; and each $R^3$ independently represents an optionally substituted alkyl or alkenyl group or a group of formula

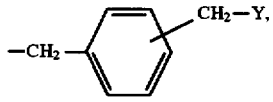

(II)

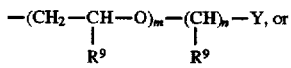

(IIIA)

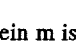

(IIIB)

wherein m is in the range 0 to 25, n is in the range 1 to 20, each $R^9$ independently represents a hydrogen atom or a methyl or ethyl group, D is derived from a saturated or unsaturated hydrocarbon containing from 20 to 500 carbon atoms, and Y represents a group of formula

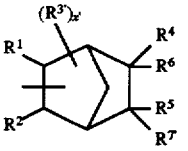

(IV)

in which $R^1$, $R^2$, $R^4$, $R^5$ and $R^6$ are as defined above; x' is 0 to 5; $R^{3'}$ is as defined for $R^3$ other than a group of formula II, IIIA or IIIB, $R^{7'}$ represents a group $R^7$ as defined above or a group —CHO or —COOH, or $R^6$ and $R^{7'}$ together represent a group

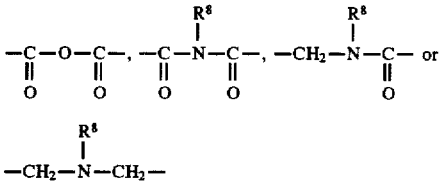

where $R^8$ is as defined above, each group $R^3$ containing a total of up to 550 carbon atoms, with the proviso that up to a maximum of 3 $R^3$ groups can each simultaneously contain a total of greater than 40 carbon atoms.

While the compounds of formula I above possess advantageous dispersancy properties, it has now surprisingly been found that certain-nitrogen-containing reaction products of polyenes have even better dispersancy properties.

SUMMARY OF THE INVENTION

In the present invention, there is provided the reaction product of: (A) an acylating reagent, with (D) a polyalkenyl derivative of an ethylenically unsaturated carboxylic reagent (C), and (E) a polyamine containing at least two —$NH_2$ and/or —NH groups, or with (F) the pre-formed product of reagents (D) and (E), wherein the acylating reagent (A) is the reaction product of (B) a $C_4$–$C_{20}$ polyene or oligomer prepared therefrom, and (C) an ethylenically unsaturated carboxylic reagent.

DESCRIPTION OF THE PREFERRED EMBODIMENT

The acylating reagent (A) is the reaction product of (B) a $C_4$–$C_{20}$ polyene or oligomer prepared therefrom and (C) an ethylenically unsaturated carboxylic reagent. The reaction is conveniently carried out in the presence of a suitable solvent at elevated temperature (i.e. above ambient temperature (20° C.), e.g. in the temperature range 25° to 200° C., often under reflux conditions and, where necessary, at elevated pressure, e.g. in the range from 2 to 100×105 Pa. Examples of solvents include hydrocarbon solvents such as hexane, cyclohexane, toluene and xylene; ether solvents such as diethyl ether, tetrahydrofuran and 1,4-dioxane; amides such as dimethylformamide and dimethylacetamide; nitriles such as acetonitrile; alcohols such as 1-pentanol (amyl alcohol) and 2-methyl-2-propanol(tert-butyl alcohol); and chlorohydrocarbons such as dichloromethane.

Reagent (B) is a $C_4$–$C_{20}$, preferably $C_4$–$C_{18}$, more preferably $C_4$–$C_{16}$ and especially $C_5$–$C_{12}$, polyene or oligomer prepared therefrom. The polyene contains two or more, preferably two (2) to four (4) carbon-carbon double bonds. Particularly preferred polyenes are those containing three (3) carbon-carbon double bonds (trienes), and especially two (2) carbon-carbon double bonds (dienes).

Examples of $C_4$–$C_{20}$ polyenes include 1,5-hexadiene, 1,7-octadiene, 1,9-undecadiene, (di)cyclopentadiene, norbornadiene, 1,2,4-trivinylcylcohexane, 1,3,5,7-cyclooctatetraene and 1,5,9^^cyclododecatriene; (di) cyclopentadiene is the most preferred polyene.

The polyenes may be used as such or in the form of oligomers. In the context of the present specification, the term "oligomer" denotes a homooligomer or co-oligomer of a diene, comprising at least two diene monomer units. The oligomers may have number average molecular weights (Mn) up to 3000, e.g. in the range from 100 to 3000, preferably from 200 to 2500, more preferably from 300 to 2000 and especially from 400 to 1500.

Preferred oligomers are co-oligomers obtainable by reacting (di)cyclopentadiene or a cyclopentadienylide, e.g. an alkali metal, preferably sodium, cyclopentadienylide, with a compound of the general formula $$RL_m \quad (I)$$

wherein m is an integer from 2 to 6, R represents a hydrocarbyl group or a polyoxyalkylene group, each of which contains from 2 to 30, preferably from 4 to 22, more preferably from 4 to 12 and advantageously from 5 to 8, carbon atoms and L represents a leaving group. The group R is preferably an alkyl or xylyl group. The leaving group, L, may, for example, be a mesylate, tosylate or hydroxyl group but is preferably a halogen atom, particularly a chlorine atom.

Examples of compounds of formula I include α,α'-dihaloxylenes (e.g. α,α'-dibromoxylene, α,α'-dichloroxylene), α,α',α"-trihalomesitylenes (e.g. α,α',α"-trichloromesitylene), pentaerythrityl tetrabromide, $C_6$ or higher dihaloalkanes (e.g. 1,6-dibromohexane, 1,7-dibromoheptane, 1,8-dibromooctane, 1,9-dibromononane, 1,10-dibromodecane, 1,11-dibromoundecane, 1,12-dibromododecane, 1,6-dichlorohexane, 1,8-dichlorooctane, 1,9-dichlorononane, 1,10-dichlorodecane), ethylene glycol, glycerol and pentaerythritol.

Preparation of the oligomers may conveniently be carried out at low temperature, e.g. from −5° to 5° C., in the presence of a suitable solvent, e.g. a hydrocarbon solvent such as toluene or xylene, or an ether solvent such as tetrahydrofuran. When cyclopentadiene is used as reagent, the preparation of the oligomers may also conveniently be carried out in the presence of a phase transfer catalyst such as that commercially available under the trade mark "Adogen 464".

The ethylenically unsaturated carboxylic reagent (C) contains a total of at least 3 carbon atoms, preferably a total of from 3 to 50, more preferably from 3 to 30, still more preferably from 4 to 20, and even more preferably from 4 to 10, carbon atoms.

The ethylenically unsaturated carboxylic reagent (C) may be an alpha-beta olefinic unsaturated carboxylic reagent as described in Page 6, lines 15 to 48 of EP-B-285,609 or Page 6, lines 11 to 39 of EP-B-287,569, e.g. acrylic acid ($C_3$), methacrylic acid ($C_4$), cinnamic acid ($C_9$), crotonic acid ($C_4$), 2-phenylpropenoic acid ($C_9$), maleic acid ($C_4$), fumaric acid ($C_4$), glutaconic acid ($C_5$), mesaconic acid ($C_5$), itaconic acid (methylene succinic acid) ($C_5$), citraconic acid (methyl maleic acid) ($C_5$) and functional derivatives thereof such as anhydrides (e.g. maleic anhydride ($C_4$), glutaconic anhydride ($C_5$), itaconic anhydride ($C_5$), citraconic anhydride ($C_5$)), esters (e.g. methyl acrylate ($C_4$)), amides, imides, salts, acyl halides and nitriles.

Preferably the ethylenically unsaturated carboxylic reagent (C) is selected from monoethylenically unsaturated $C_4$–$C_{10}$ dicarboxylic acids and anhydrides, of which maleic anhydride is most preferred.

In the preparation of the acylating reagent (A) and the polyalkenyl derivative (D), the same or different ethylenically unsaturated carboxylic reagents (C) may be used. In a preferred aspect of the invention, maleic anhydride is used in the preparation of both reagents (A) and (D).

Reagent (D) is a polyalkenyl derivative of an ethylenically unsaturated carboxylic reagent (C), the preparation of which is known in the art. For example, if reagent (D) is a polyalkenyl derivative of an ethylenically unsaturated carboxylic reagent such as maleic anhydride, it may conveniently be prepared by mixing a polyalkene with a specified amount of maleic anhydride and passing chlorine through the mixture, e.g. as described in GB-A-949,981. Alternatively, the derivative may be prepared by reacting thermally, at an appropriate temperature, the polyalkene with a specified amount of maleic anhydride, e.g. as described in GB-A-1,483,729. A particularly preferred process for preparing such a derivative, which is described in EP-A-542,380 (Applicant's ref: T 1627 EPC), involves reacting the polyalkene with maleic anhydride in a mol ratio maleic anhydride to polyalkene of greater than 1:1, at a temperature in the range from 150° to 260° C. and in the presence of a polyaddition-inhibiting amount of a sulphonic acid.

The polyalkene from which reagent (D) is derived may be a homopolymer or copolymer, for example of at least one $C_2$–$C_{10}$ monoolefin. Preferably the polyalkene is a polymer of at least one $C_2$–$C_5$ monoolefin, e.g. an ethylene-propylene copolymer. The monoolefin is preferably a $C_3$–$C_4$ olefin and preferred polyalkenes derived therefrom include polyisobutylenes and atactic or isotactic propylene oligomers. Polyisobutylenes such as that sold by BASF under the trade mark "GLISSOPAL" and those sold by the British Petroleum Company under the trade marks "Ultravis", "Hyvis" and "Napvis", e.g. "Hyvis 75", "Hyvis 120", "Hyvis 200" and "Napvis 120" polyisobutylenes, are especially preferred for use in the present invention.

The polyalkene has a number average molecular weight ($M_n$) preferably in the range from 300 to 7000, more preferably from 500 to 5000, still more preferably from 1000 to 4000 and advantageously from 2000 to 3000.

The polyamine (E) contains at least two —$NH_2$ and/or —NH groups, the groups each having at least one active hydrogen thereon. Examples of polyamines useful in the present invention are those described in, the text from Page 16, line 21 to Page 19, line 53 of EP-B-287,569.

Preferably the polyamine (E) is a compound of the general formula $$H_2N—(CHR^1)_x—CH_2—[A—CH_2—(CHR^1)_x]_y—NH_2 \quad (II)$$

wherein A is —NH or —O—, each $R^1$ independently represents a hydrogen atom or a methyl group, x is in the range 1 to 3, and y is in the range 1 to 10 when A is —NH or y is in the range 1 to 200 when A is —O—.

In formula II above, it is preferred that when A is —NH, then x is 1, each $R^1$ represents a hydrogen atom, and y is in the range 1 to 8; or when A is —O—, then x is 1, each $R^1$ represents a methyl group and y is in the range 1 to 50.

Reagent (F) is the pre-formed product of reagents (D) and (E) and is prepared according to techniques conventional in the art. Thus, for example, if reagent (D) is a polyalkenyl derivative of maleic anhydride and reagent (E) is an ethylene polyamine, they may conveniently be reacted together in a molar ratio of (D) to (E) from 1–4:1, in a hydrocarbon solvent at a temperature in the range from 100° to 250° C., e.g. as described in EP-A-587,250.

The present invention further provides a process for the preparation of a reaction product according to the invention which comprises reacting (A) an acylating reagent, with (D) a polyalkenyl derivative of an ethylenically unsaturated carboxylic reagent (C), and (E) a polyamine containing at least two —$NH_2$ and/or —NH groups, or with (F) the pre-formed product of reagents (D) and (E), wherein the acylating reagent (A) is the reaction product of (B) a $C_4$–$C_{20}$ polyene or oligomer prepared therefrom, and (C) an ethylenically unsaturated carboxylic reagent.

The process may be carried out in the absence of a solvent but is conveniently carried out in the presence of a solvent, e.g. any of those mentioned above, and at elevated temperature (i.e. above ambient temperature (20° C.)), for example, in the temperature range 30° to 200° C. The process is preferably carried out under reflux conditions.

The weight ratio of reagent (A) to reagent (D) used in the present process is preferably in the range from 1:2 to 1:1000, more preferably from 1:4 to 1:500, still more preferably from 1:5 to 1:100 and especially from 1:5 to 1:50.

The weight ratio of reagents (A) plus (D) to reagent (E) (i.e. the ratio of the total combined weight of reagents (A) and (D) to the weight of reagent (E)) used in the present process is preferably in the range from 0.5:1 to 200:1, more preferably from 2:1 to 100:1, still more preferably from 2:1 to 50:1 and especially from 5:1 to 30:1.

The weight ratio of reagent (A) to reagent (F) used in the present process is preferably in the range from 1:2 to 1:1000, more preferably from 1:4 to 1:500, still more preferably from 1:5 to 1:200 and, advantageously, from 1:10 to 1:100.

The reaction product of reagents (A), (D) and (E) or reagents (A) and (F) may be used as a dispersant additive in lubricating oils. Accordingly, the present invention provides a lubricating oil composition comprising a major amount (more than 50% w) of a lubricating oil and a minor amount (less than 50% w), preferably from 0.1 to 10% w, especially from 0.5 to 5% w (active matter), of a reaction product according to the invention, the percentages by weight being based on the total weight of the composition.

Suitable lubricating oils are natural, mineral or synthetic lubricating oils.

Natural lubricating oils include animal and vegetable oils, such as castor oil. Mineral oils comprise the lubricating oil fractions derived from crude oils, coal or shale, which fractions may have been subjected to certain treatments such as clay-acid, solvent or hydrogenation treatments. Synthetic lubricating oils include synthetic polymers of hydrocarbons, modified alkylene oxide polymers, and ester lubricants, which are known in the art. These lubricating oils are preferably crankcase lubricating oils for spark-ignition and compression-ignition engines, but include also hydraulic lubricants, metal-working fluids and automatic transmission fluids.

Preferably the lubricating base oil component of the compositions according to the present invention is a mineral lubricating oil or a mixture of mineral lubricating oils, such as those sold by member companies of the Royal Dutch/Shell Group under the designations "HVI", or "XHVI" (trade mark).

The viscosity of the lubricating base oils present in the compositions according to the present invention may vary within wide ranges, and is generally from 3 to 35 $mm^2/s$ at 100° C.

The lubricating oil compositions according to the present invention may contain various other additives, known in the art, such as viscosity index improvers, e.g. linear or star-shaped polymers of a diene such as isoprene or butadiene, or a copolymer of such a diene with optionally substituted styrene. These copolymers are suitably block copolymers and are preferably hydrogenated to such an extent as to saturate most of the olefinic unsaturation. Other suitable additives include dispersant V.I. improvers such as those based on block copolymers, or polymethacrylates, extreme pressure/anti-wear additives such as zinc or sodium dithiophosphates, ashless dispersants such as polyolefin-substituted succinimides, e.g. those described in GB-A-2 231 873, anti-oxidants, friction modifiers or metal-containing detergents such as phenates, sulphonates, alkylsalicylates or naphthenates, all of which detergents may be overbased.

The reaction product of reagents (A), (D) and (E) or reagents (A) and (F) may also be used as a dispersant additive in fuels. Accordingly, the present invention further provides a fuel composition comprising a major amount (more than 50% w) of a fuel and a minor amount (less than 50% w), preferably from 0.001 to 2% w, more preferably from 0.001 to 0.5% w and especially from 0.002 to 0.2% w (active matter), of a reaction product according to the invention, the percentages by weight being based on the total weight of the composition.

Suitable fuels include gasoline and diesel fuel. These base fuels may comprise mixtures of saturated, olefinic and aromatic hydrocarbons. They can be derived from straight-run gasoline, synthetically produced aromatic hydrocarbon mixtures, thermally catalytically cracked hydrocarbon feedstocks, hydrocracked petroleum fractions or catalytically reformed hydrocarbons.

The fuel compositions according to the present invention may contain various other additives known in the art such as a lead compound as anti-knock additive; antiknock additives other than lead compounds such as methyl cyclopentadienyl-manganese tricarbonyl or ortho-azidophenyl; co-antiknock additives such as benzoylacetone; dehazers (e.g. ethoxylated glycerols such as that commercially available as "SURDYNE" (trade mark) M155 (ex Shell Chemicals, UK) or alkoxylated phenol formaldehyde polymers such as those commercially available as "NALCO" (trade mark) 7DO7 (ex Nalco), "TOLAD" (trade mark) 2683 (ex Petrolite) or "SURDYNE" (trade mark) D265, M153, M154 or M156 (ex Shell Chemicals, UK)); anti-foaming agents (e.g. the polyether-modified polysiloxanes commercially available as "TEGOPREN" (trade mark) 5851, Q 25907 (ex Dow Corning) or "RHODORSIL" (trade mark) ex Rhone Poulenc)); ignition improvers (e.g. 2-ethylhexyl nitrate, cyclohexyl nitrate, di-tertiary-butyl peroxide and those disclosed in U.S. Pat. No. 4,208,190 at Column 2, line 27 to Column 3, line 21); anti-rust agents (e.g. that commercially sold by Rhein Chemie, Mannheim, Germany as "RC 4801", or polyhydric alcohol esters of a succinic acid derivative, the succinic acid derivative having on at least one of its alpha carbon atoms an unsubstituted or substituted aliphatic hydrocarbon group containing from 20 to 500 carbon atoms, e.g. the pentaerythritol diester of polyisobutylene-substituted succinic acid); reodorants; anti-wear additives; anti-oxidants (e.g. phenolics such as 2,6-di-tert-butylphenol, or phenylenediamines such as N,N'-di-sec-butyl-p-phenylenediamine); metal deactivators; lubricity agents (e.g. those commercially available as EC831 (ex Paramins) or "HITEC" (trade mark) 580 (ex Ethyl Corporation)); or carrier fluids such as a polyether e.g. a $C_{12}$–$C_{15}$ alkyl-substituted propylene glycol ("SAP 949" which is commercially available from member companies of the Royal Dutch/Shell group), "HVI" or "XHVI" base oil, a polyolefin derived from $C_2$–$C_6$ monomers, e.g. polyisobutylene having from 20 to 175, particularly 35 to 150, carbon atoms, or a polyalphaolefin having a viscosity at 100° C. in the range $2\times10^{-6}$ to $2\times10^{-5}$ $m^2/s$ (2 to 20 centistokes), being a hydrogenated oligomer containing 18 to 80 carbon atoms derived from at least one alphaolefinic monomer containing from 8 to 18 carbon atoms.

The lubricating oil and fuel compositions of the invention may be prepared by adding the reaction product of reagents (A), (D) and (E) or reagents (A) and (F) separately to a lubricating oil or fuel. Conveniently, an additive concentrate is blended with the lubricating oil or fuel. Such a concentrate generally comprises an inert carrier fluid and one or more additives in a concentrated form. Hence the present invention also provides an additive concentrate comprising an inert carrier fluid and from 10 to 80% w (active matter) of a reaction product according to the invention, the percentages by weight being based on the total weight of the concentrate.

Examples of inert carrier fluids include hydrocarbons and mixtures of hydrocarbons with alcohols or ethers, such as methanol, ethanol, propanol, 2-butoxyethanol or methyl tert-butyl ether. For example, the carrier fluid may be an aromatic hydrocarbon solvent such as toluene, xylene, mixtures thereof or mixtures of toluene or xylene with an alcohol. Alternatively, the carrier fluid may be a mineral base oil, such as those sold by member companies of the Royal Dutch/Shell Group under the designations "HVI" or "XHVI" (trade mark), e.g. "HVI 60" base oil.

The present invention still further provides the use of a reaction product according to the invention as a dispersant additive.

The present invention will be further understood from the following illustrative examples which are included for illustrative purposes only and are not to be construed as limiting the invention. In these examples, the number average molecular weights ($M_n$) specified for the polyisobutenyl moieties in the polyisobutenyl succinic anhydride/succinimide were determined by quantitative reaction with ozone, on the assumption that each oligomer chain contains one double bond, as will be readily understood by those skilled in the art. In all other instances, the number average molecular weights quoted were determined by modern gel permeation chromatography using polystyrene standards, e.g. as described in W. W. Yau, J. J. Kirkland and D. D. Bly, "Modern Size Exclusion Liquid Chromatography", John Wiley and Sons, New York, 1979.

Active matter content was determined by separating inactive material from the desired active matter on an aluminum oxide column using diethyl ether as eluant; acid value was determined according to ASTM D 664; and Total Base Number (adjusted to 100% active matter) was determined in accordance with ASTM D 2896.

EXAMPLE 1

(i) Preparation of a polyanhydride (phase transfer catalyst route)

An ice cold, aqueous solution of potassium hydroxide (50% aq, 375 g) was added to an ice cold, stirred solution of cyclopentadiene (105 g, 1.59 mol), α,α'-dichloroxylene (255 g, 1.73 mol) and methyltrialkyl ($C_8$–$C_{10}$) ammonium chloride (10 g) (a phase transfer catalyst available commercially under the trade mark "Adogen 464") in toluene (200 ml). The reaction mixture was allowed to warm up to ambient temperature (20° C.) and was then stirred at 80° C. for two hours. The reaction mixture was subsequently cooled and diluted with petroleum spirit (1000 ml). The solution was washed with water (5×1000 ml) until a neutral pH was obtained and then dried over magnesium sulphate. Any unreacted cyclopentadiene and petroleum spirit were removed under reduced pressure to give the crude product, xylyl-bridged cyclopentadiene oligomers of the general formula

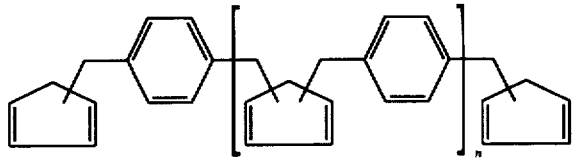

The crude product and maleic anhydride (170 g, 1.73 mol) were dissolved in toluene (1000 ml) and heated at reflux under a blanket of nitrogen for a period of two hours. Toluene and any unreacted maleic anhydride were stripped off (180° C. at 10 mmHg for three hours) to yield the polyanhydride derivatives of the xylyl-bridged cyclopentadiene oligomers as a brown solid (360 g) having $M_n$ in the range 800 to 1100. Infrared spectral analysis of the product showed vmax at 1851 $cm^{-1}$ (s) and 1785 $cm^{-1}$ (s).

(ii) Preparation of a polyimide

To a solution of the polyanhydride derivatives obtained in (i) above (94.14 g) dissolved in tetrahydrofuran (1200 ml) was added a xylene solution (2454 g) of a polyisobutenyl succinic anhydride (PIBSA; polyisobutenyl $M_n$ 2400) prepared by the process described in EP-A-542,380 (Applicant's ref: T-1627 EPC). (The PIBSA/xylene solution contained 42.3% w xylene and 37.6% w active matter PIBSA. The acid value of the PIBSA (after removal of the xylene) was found to be 0.486 meq/g.) The mixture so formed was stirred with toluene (4.5 l) until it was homogeneous. A polyamine mixture (92.81 g) containing tetraethylene pentamine, pentaethylene hexamine and higher ethylene polyamines in a weight ratio of 1:2:1 (commercially available from Delamine B.V., Netherlands) was then added and the resulting composition heated to 120° C. for four hours, with removal of water and tetrahydrofuran using a Dean and Stark trap. Extraction of solvent under reduced pressure (400 Pa, 130° C.) yielded the desired (crude) end product, the polyimide derivatives of the xylyl-bridged cyclopentadiene oligomers (1495 g). Infrared spectral analysis of the end product showed vmax at 1770 $cm^{-1}$ (m) and 1700 $cm^{-1}$ (vs). The end product had a total base number of 1.42 mg KOH/g and a nitrogen content of 3.15 % w.

EXAMPLE 2 TO 7

By processes similar to that described in Example 1 above, further polyimide derivatives according to the invention were prepared. Details of the types and amounts of the reagents used and, where known, the total base number and nitrogen content of the polyimide derivatives obtained are presented in Table I below in which the following abbreviations are used:

PIBSA: a xylene solution containing 37.6% w active matter of a polyisobutenyl succinic anhydride in which the polyisobutenyl moiety has $M_n$ 2400, prepared by the process according to EP-A-542,380 (Applicant's ref: T-1627 EPC), the anhydride having an acid value (after removal of the xylene) of 0.486 meq/g PEHA: pentaethylene hexamine S75: a polyamine mixture containing tetraethylene pentamine, pentaethylene hexamine and higher ethylene polyamines in a weight ratio of 1:2:1 which is commercially available from Delamine B.V., Netherlands HEPA: a polyamine mixture containing hexaethylene heptamine and higher ethylene polyamines which is commercially available from Delamine B.V., Netherlands

TABLE I

| Example No. | Reagents: Product of Example 1 (i) (g) | PIBSA (g) | Polyamine (g) | Polyimide Derivatives: Total Bas Number (mg KOH/g) | Nitrogen Content (% w) |
|---|---|---|---|---|---|
| 2 | 2.03 | 39 | PEHA (1.9) | 2.8 | 2.6 |
| 3 | 1.27 | 49 | PEHA (1.8) | 2.3 | 2.0 |
| 4 | 2.54 | 49 | S75 (2.5) | 3.05 | 4.75 |
| 5 | 1.27 | 49 | S75 (1.8) | 2.1 | 3.77 |
| 6 | 2.54 | 49 | HEPA (2.9) | 3.4 | 5.40 |
| 7 | 1.27 | 49 | HEPA (2.2) | 3.2 | 4.45 |

EXAMPLE 8

(i) Preparation of a polyanhydride (cyclopentadienylide anion route)

Sodium cyclopentadienylide 2M (50 ml, 0.1 mol) was added over a period of one hour to an ice cold, stirred solution of α,α'-dibromoxylene (13.2 g, 0.05 mol) in tetrahydrofuran (200 áml). The reaction mixture was stirred at 0° C. for half an hour, filtered and diluted with xylene (200 ml). The mixture was concentrated carefully under reduced pressure to remove any unreacted cyclopentadiene and tetrahydrofuran, to give a xylene solution (230 ml) of xylyl-bridged cyclopentadiene oligomers of the general formula

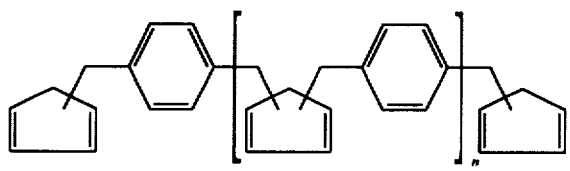

Maleic anhydride (20 g, 0.2 mol) was added to the xylene solution of the oligomers and the reaction mixture was refluxed for one hour. Removal of xylene and any unreacted maleic anhydride under reduced pressure yielded the polyanhydride derivatives of the xylyl-bridged cyclopentadiene oligomers as a brown solid (20 g) having $M_n$ 1400. Infrared spectral analysis of the product showed $v_{max}$ at 1850 $cm^{-1}$ (s) and 1785 $cm^{-1}$ (s).

(ii) Preparation of a polyimide

The polyanhydride derivatives obtained in (i) above (0.8 g) were added, with stirring, to a reaction vessel containing toluene (300 ml), tetrahydrofuran (50 ml), triethylene tetramine (0.6 g, 4.1 mmol), and a polyisobutenyl succinic anhydride (22 g) (65% w active matter; polyisobutenyl $M_n$ 2400; acid value of 0.486 meq/g) prepared by the process described in EP-A-542,380 (Applicant's ref: T-1627 EPC). The reaction mixture was refluxed for an hour and a half, with removal of water using a Dean and Stark trap. Extraction of solvent under reduced pressure yielded the desired (crude) end product, the polyimide derivatives of the xylyl-bridged cyclopentadiene oligomers (22 g). Infrared spectral analysis of the end product showed $v_{max}$ at 1770 $cm^{-1}$ (m) and 1700 $cm^{-1}$ (vs). The end product had a total base number of 0.5 mg KOH/g and a nitrogen content of 1.4% w.

EXAMPLE 9

The procedure described in Example 8 (ii) was repeated using 0.72 g of the polyanhydride derivatives, 0.9 g pentaethylene hexamine and 19 g of the polyisobutenyl succinic anhydride. Infrared spectral analysis of the end product showed vmax at 1770 $cm^{-1}$ (m) and 1700 $cm^{-1}$ (vs). The end product had a total base number of 1.1 mg KOH/g and a nitrogen content of 2.0% w.

EXAMPLE 10

Preparation of a polyimide 0.31 g of polyanhydride derivatives of xylyl-bridged cyclopentadiene oligomers prepared as described in Example 1(i) above was added to a stirred solution of a polyisobutylene (PIB) succinimide (62.7 g) (47.8% w active matter; polyisobutenyl $M_n$ 2400) prepared according to EP-A-587,250 (Applicant's ref: T-1665 EPC) in toluene (400 ml) and tetrahydrofuran (25 ml). The reaction mixture was refluxed for an hour and a half, with removal of water and tetrahydrofuran using a Dean and Stark trap. Subsequent extraction of solvent under reduced pressure yielded the desired (crude) end product, the polyimide derivatives of the xylyl-bridged cyclopentadiene oligomers (62.9 g). Infrared spectral analysis of the end product showed $v_{max}$ at 1770 $cm^{-1}$ (m) and 1700 $cm^{-1}$ (vs). The end product had a total base number of 0.7 mg KOH/g and a nitrogen content of 2.5% w.

EXAMPLES 11 TO 15

In these examples, the procedure of Example 10 was repeated using different amounts of the polyanhydride derivatives and/or polyisobutylene succinimide as detailed in Table II below. Table II also shows the total base number and nitrogen content of the polyimide derivatives obtained.

TABLE II

| Example No. | Reagents: Product of Example 1 (i) (g) | PIB Succinimide (g) | Polyimide Derivatives: Total Base Number (mg KOH/g) | Nitrogen Content (% w) |
|---|---|---|---|---|
| 11 | 3 | 62.7 | 0.27 | 2.4 |
| 12 | 0.88 | 29.3 | 0.51 | 2.5 |
| 13 | 1.5 | 62.7 | 0.49 | 2.4 |
| 14 | 1.5 | 62.7 | 0.58 | 2.4 |
| 15 | 0.31 | 31 | 0.49 | 2.4 |

EXAMPLE 16

(i) Preparation of a polyanhydride (phase transfer catalyst route)

An ice cold, aqueous solution of potassium hydroxide (50% aq, 100 g) was added to an ice cold, stirred solution of cyclopentadiene (21 g, 0.32 mol), pentaerythrityl tetrabromide (12 g, 0.032 mol) and methyltrialkyl ($C_8$–$C_{10}$) ammonium chloride (5 g) (a phase transfer catalyst available commercially under the trade mark "Adogen 464") in toluene (200 ml). The reaction mixture was allowed to warm up to ambient temperature (20° C.) and was then stirred at 80° C. for two hours. The reaction mixture was subsequently cooled and diluted with petroleum spirit (500 ml). The solution was washed with water (5×500 ml) until a neutral pH was obtained and then dried over magnesium sulphate. Any unreacted cyclopentadiene and petroleum spirit were removed under reduced pressure to give the crude product, alkylated cyclopentadiene oligomers.

The crude product and maleic anhydride (40 g, 0.41 mol) were dissolved in toluene (400 ml) and heated at reflux under a blanket of nitrogen for a period of two hours. Toluene and any unreacted maleic anhydride were stripped off (180° C. at 10 mmHg for three hours) to yield the polyanhydride derivatives of the alkylated cyclopentadiene oligomers as a brown solid (23.3 g) having $M_n$ 440. Infrared spectral analysis of the product showed $v_{max}$ at 1851 $cm^{-1}$ (s) and 1785 $cm^{-1}$ (s).

(ii) Preparation of a polyimide 0.31 g of the polyanhydride derivatives obtained in (i) above was added to a stirred solution of the polyisobutenyl succinimide (62.7 g) described in Example 10 in toluene (400 ml) and tetrahydrofuran (25 ml). The reaction mixture was refluxed for an hour and a half, with removal of water using a Dean and Stark trap. Subsequent extraction of solvent under reduced pressure gave the desired (crude) end product, the polyimide derivatives of the alkylated cyclopentadiene oligomers (62.9 g). Infrared spectral analysis of the end product showed $v_{max}$ at 1770 $cm^{-1}$ (m) and 1700 $cm^{-1}$ (vs). The end product had a total base number of 0.71 mg KOH/g and a nitrogen content of 2.5% w.

EXAMPLES 17 AND 18

In these examples, the procedure of Example 16 (ii) was repeated using different amounts of the polyanhydride derivatives, as indicated in Table III below. The total base number and nitrogen content of the polyimide derivatives obtained are also shown in Table III.

TABLE III

| | Reagents | | Polyimide Derivatives | |
|---|---|---|---|---|
| Example No. | Product of Example 16 (i) (g) | PIB Succinimide (g) | Total Base Number (mg KOH/g) | Nitrogen Content (% w) |
| 17 | 3 | 62.7 | 0.66 | 2.4 |
| 18 | 1.58 | 62.7 | 0.7 | 2.5 |

EXAMPLE 19

An ice cold, aqueous solution of potassium hydroxide (50% aq, 50 g) was added to an ice cold, stirred solution of cyclopentadiene (10 ml, 0.125 mol), α,α'-dichloroxylene (11 g, 0.063 mol) and methyltrialkyl ($C_8$–$C_{10}$) ammonium chloride (1 g) (a phase transfer catalyst available commercially under the trade mark "Adogen 464") in toluene (20 ml). The reaction mixture was allowed to warm up to ambient temperature (20° C.) and was then stirred at 80° C. for two hours. The reaction mixture was subsequently cooled and diluted with petroleum spirit (100 ml). The solution was washed with water (5×100 ml) until a neutral pH was obtained and then dried over magnesium sulphate. Any unreacted cyclopentadiene and petroleum spirit were removed under reduced pressure to give the crude product, xylyl-bridged cyclopentadiene oligomers of the general formula

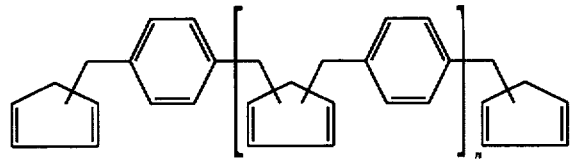

The crude product and methyl acrylate (17 g, 0.2 mol) were dissolved in toluene (100 ml) and heated at reflux under a blanket of nitrogen for a period of two hours. Toluene and any unreacted methyl acrylate were stripped off (180° C. at 10 mmHg for three hours) to yield the poly(methyl acrylate) derivatives of the xylyl-bridged cyclopentadiene oligomers as a brown solid (15 g). Infrared spectral analysis of the product showed $v_{max}$ at 1737 $cm^{-1}$ (s).

EXAMPLE 20

1,5-hexadiene (10 g, 0.122 mol) and maleic anhydride (50 g, 0.51 mol) in toluene (20 ml) were heated in a sealed autoclave at 180° C. for 24 hours. Solvent and any unreacted maleic anhydride were removed under reduced pressure (140° C., 500 Pa) to give the crude double-ene, Diels-alder adduct (15 g). Infrared spectral analysis of the product showed $v_{max}$ at 1858 $cm^{-1}$ (s) and 1777 $cm^{-1}$ (s).

Reaction of the products of Examples 19 and 20 with reagents (D) and (E) or the pre-formed product of reagents (D) and (E) as described above would give further reaction products in accordance with the present invention.

EXAMPLE 21

(i) Carbon Black Dispersancy Test (CBDT) (British Rail Publication BR 669: 1984)

Samples of a SAE 15W40 Middle East lubricating oil containing a commercial package of a zinc dialkyldithiophosphate, an overbased calcium alkyl salicylate and VI improver, were modified by incorporation of the polyimide derivatives of Examples 1 to 18 to give oils containing the derivatives at a concentration of 1% w active matter. 3% w of carbon black was then added to each oil and (percentage) increase in kinematic viscosity at 60° C. was determined, using an Ubbelohde viscometer. A low result indicates good performance. The absolute values obtained are dependent on the active surface area of the carbon black used, and therefore comparative series should be tested with identical samples of carbon black. The tests were carried out using "Flamruss" (trade mark) carbon black.

(ii) Fluoroelastomer Seal Compatibility Test (FSCT)

The polyimide derivatives of Examples 1 and 8 to 18 were incorporated in lubricating oils to give concentrations of 1.5% w active matter and tested for compatibility with fluoroelastomer seal materials according to the method of DIN 53504 and, specifically, Daimler Benz specification DB 6615. Percentage reduction in tensile strength (TS) and elongation at break (EB) were assessed. The test results depend upon the particular seal materials used, and therefore comparative series should be tested with seals from consistent batches. A low result indicates good performance.

Results of these tests are given in Table IV following:

TABLE IV

| Polyimide Derivatives of Example | CBDT (%) | FSCT TS (%) | FSCT EB (%) |
|---|---|---|---|
| 1 | 15 | 30 | 29 |
| 2 | 15 | — | — |
| 3 | 21 | — | |
| 4 | 20 | — | — |
| 5 | 15 | — | — |
| 6 | 19 | — | — |
| 7 | 22 | — | — |
| 8 | 29 | 9 | 8 |
| 9 | 15 | 19 | 20 |
| 10 | 21.5 | 19 | 18 |
| 11 | 23.6 | 7* | 1* |
| 12 | 17.4 | 3* | 4 |
| 13 | 16.6 | 16 | 19 |
| 14 | 24.3 | 12 | 11 |
| 15 | 18.3 | 5 | 11 |
| 16 | 17 | 24 | 21 |
| 17 | 17.1 | 0.5* | 2.7 |
| 18 | 17.9 | 8 | 10 |

*Percentage increase in tensile strength/elongation at break

What is claimed is:

1. A reaction product for use in fuels prepared by reacting:

(a) the pre-formed product of a polyalkenyl derivative of an ethylenically unsaturated carboxylic reagent and a polyamine containing at least two —$NH_2$ and/or —NH groups; and (b) the reaction product prepared by reacting a $C_4$–$C_{20}$ polyene or oligomer prepared therefrom with an ethylenically unsaturated carboxylic reagent in the presence of a solvent at a temperature from about 25° C. to about 200° C., and at a pressure from about 2 to about $100\times10^5$ Pa.

2. The reaction product of claim 1 wherein the reaction product (b) is prepared by reacting a $C_5$–$C_{12}$ polyene or oligomer prepared therefrom, with an ethylenically unsaturated carboxylic reagent selected from monoethylenically unsaturated $C_4$–$C_{10}$ dicarboxylic acids and anhydrides.

3. A reaction product of claim 2 wherein the reaction product (b) is prepared by reacting an oligomer obtainable by reacting a cyclopentadienylide with a compound of the general formula $$\text{Rlm} \qquad \text{(I)}$$

wherein m is an integer from 2 to 6, R represents a hydrocarbyl group or a polyoxyalkylene group, each of which contains from 2 to 30 carbon carbon atoms, and L represents a leaving group selected from a mesylate, tosylate, hydroxyl group or halogen atom.

4. The reaction product of claim 2 wherein the polyakenyl derivative is derived from a polymer of at least one $C_2$–$C_5$ monoolefin.

5. The reaction product of claim 4 wherein monoolefin is propylene or isobutylene.

6. The reaction product of claim 1 wherein the polyamine is a compound of the general formula $$H_2N—(CH—R^1)X—CH_2—[A—CH_2—(CH—R^1)_x]_y—NH_2 \qquad \text{(II)}$$

wherein A is —NH or —O—, each R independently represents a hydrogen atom or a methyl group, x is from about 1 to about 3, and y is from about 1 to about 10 when A is —NH or y is from about 1 to about 200 when A is —O—.

7. A fuel composition comprising a major amount of a fuel and a minor amount of a reaction product prepared by reacting (a) the pre-formed product of a polyalkenyl derivative of an ethylenically unsaturated carboxylic reagent and a polyamine containing at least two —$NH_2$ and/or —NH groups; and (b) the reaction product prepared by reacting a $C_4$–$C_{20}$ polyene or oligomer prepared therefrom, with an ethylenically unsaturated carboxylic reagent in the presence of a solvent at a temperature from about 25° C. to about 200° C. and at a pressures from about 2 to about $100\times10^5$ Pa.

8. An additive concentrate for fuels comprising a inert carrier fluid and from 10 to 80% w. based on the total concentrate, of a reaction product prepared by reacting (a) the pre-formed product of a polyalkenyl derivative of an ethylenically unsaturated carboxylic reagent and a polyamine containing at least two —$NH_2$ and/or —NH groups; and (b) the reaction product prepared by reacting a $C_5$–$C_{12}$ polyene or oligomer prepared therefrom, with an ethylenically unsaturated carboxylic reagent in the presence of a solvent at a temperature from about 25° C. to about 200° C. and at pressures from about 2 to about $100\times10^5$ Pa.

* * * * *